US005117614A

United States Patent [19]

Johnsen

[11] Patent Number: 5,117,614

[45] Date of Patent: Jun. 2, 1992

[54] HIGH SPEED BALING MACHINE

[75] Inventor: Hugo Johnsen, Campbellville, Canada

[73] Assignee: Johnsen Machine Company Ltd., Ontario, Canada

[21] Appl. No.: 641,232

[22] Filed: Jan. 11, 1991

Related U.S. Application Data

[63] Continuation of Ser. No. 469,109, Jan. 24, 1990, abandoned.

[30] Foreign Application Priority Data

Jan. 24, 1989 [CA] Canada ..... 589010

[51] Int. Cl.[5] ..... B65B 35/50

[52] U.S. Cl. ..... 53/540; 53/171; 53/247; 53/248

[58] Field of Search ..... 53/170, 171, 245, 247, 53/248, 535, 536, 540; 414/790.5, 790.6, 791.2, 924

[56] References Cited

U.S. PATENT DOCUMENTS

| | | | |
|---|---|---|---|
| 3,604,181 | 9/1971 | Adcox | 53/540 X |
| 3,641,735 | 2/1972 | Daily et al. | 414/790.6 X |
| 3,672,118 | 6/1972 | De Jong et al. | 53/245 X |
| 3,724,163 | 4/1973 | Roussel | 53/171 |
| 3,745,740 | 7/1973 | Williams | 53/535 X |
| 3,860,127 | 1/1975 | Fassman | 414/791.2 |
| 3,880,421 | 4/1975 | Müller | 414/791.2 X |
| 4,027,460 | 6/1977 | Orr | 53/535 |
| 4,045,940 | 9/1977 | White et al. | 53/500 X |
| 4,054,015 | 10/1977 | Rowell | 53/540 X |

*Primary Examiner*—Robert L. Spruill
*Assistant Examiner*—Daniel B. Moon
*Attorney, Agent, or Firm*—Rogers & Scott

[57] ABSTRACT

The invention provides a baling machine for baling groups of packages containing product into a bale bag. Packages are transported to fall down a chute individually where they are stacked in a group until the group is allowed to fall into a bale bag and into engagement with a moving platform which decelerates the group to minimize impact and resulting bruising. The filled bale bag is then ejected and closed.

5 Claims, 6 Drawing Sheets

HIGH SPEED BALING MACHINE

This application is a continuation of application Ser. No. 07/469,109 filed on Jan. 24, 1990.

FIELD OF THE INVENTION

This invention relates to baling machines which load several packages of product into a single bale bag, and more particularly to details of a high speed baling machine which minimizes product damage commonly caused by rough handling.

The invention will be explained with reference to potato baling but it is also suitable for baling other types of packaged products, such as ice and more particularly fruits and vegetables.

BACKGROUND INFORMATION

Many types of products are sold in relatively small packages, such as for example potatoes which are commonly sold in bags of five or ten pounds, and ice which is commonly sold in ten pound bags. Handling and shipping products in packages of such a small size increases costs and so it is common to place a number of small packages of product into a larger bag weighing between forty and sixty pounds. This procedure is known as "baling" and the bag is known as a "bale bag".

Baling is often done manually. A hoop is used to suspend an open bale bag and packages of product are dropped one at a time into the bale bag. When full, the bag is tied shut. Manual baling does reduce handling during shipping but it is a labour intensive practice.

An alternative to manual baling is to use an automatic baling machine or baler. In one such baler, packages are dropped into a chute which is closed at the bottom by trap doors to hold a selected number of packages in the chute. When the chute is full, the doors are opened to permit the packages to drop into a bale bag suspended below the chute. The full bale bag is taken from beneath the chute by a conveyor and closed by an automatic tying machine. Commonly this type of baling machine provides a dramatic increase in speed and a significant saving in labour over manual baling. One drawback however is that when the packages drop into the bale bag, the bottom package can be damaged because of the impact when the package meets supporting structure under the bale bag. This problem is most significant when baling perishables which bruise relatively easily.

The problem of product damage has been addressed in part by machines which are equipped with one or more pairs of fingers arranged to slow the package as it falls into the bale bag. This is a compromise solution because the fingers limit operating speed and affect the type and strength of bale bag needed in the machine.

One other drawback which is common to many baling machines is that they are very specialized. Normally a baling machine is designed for a particular bag size and type of product. As a result a packaging plant may require different baling machines for each size of package and type of product being baled.

One object of this invention is to provide an automatic baling machine which minimizes damage to product.

A further object is to provide a baling machine which will accept a range of products and packages to provide increased flexibility in baling operations.

SUMMARY OF THE INVENTION

In one of its aspects the invention provides a baling machine for baling selected numbers of packages containing product into bale bags. Packages are transported to fall down a chute individually where they are stacked until the group is allowed to fall into the bale bag and into engagement with a moving platform under the bale bag to decelerate the falling packages thereby minimizing impact with the platform. The filled bale bag is then ejected and closed.

DESCRIPTION OF THE PREFERRED EMBODIMENT

Construction and operation of the invention will now be explained with reference to a preferred embodiment of baler which is designed to bale either five or ten pound packages of potatoes into standard size bale bags. Clearly the baler can be modified to accommodate other packages and products.

Figures 1, 3:
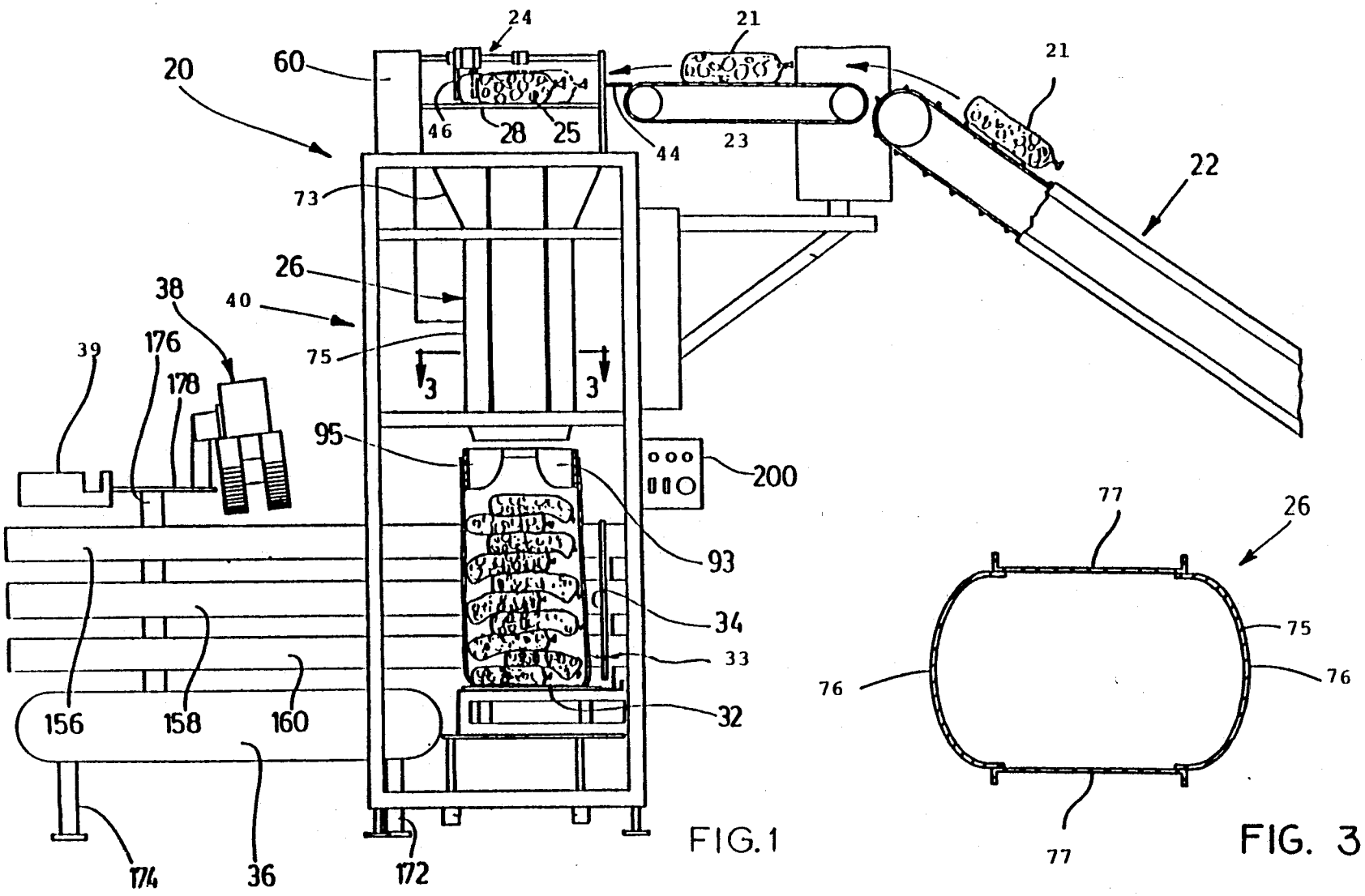
FIG. 1 is a side view of a preferred embodiment of a baling machine according to the invention, and shown in operation baling packages of potatoes which enter by a conveyor into the front of the machine and which leave at the bottom and back of the machine, some parts such as the bag supplying apparatus being omitted for clarity.
FIG. 3 is a cross-sectional view on line 3—3 of FIG. 1 and showing detail of a chute to a larger scale.
Figure 2:
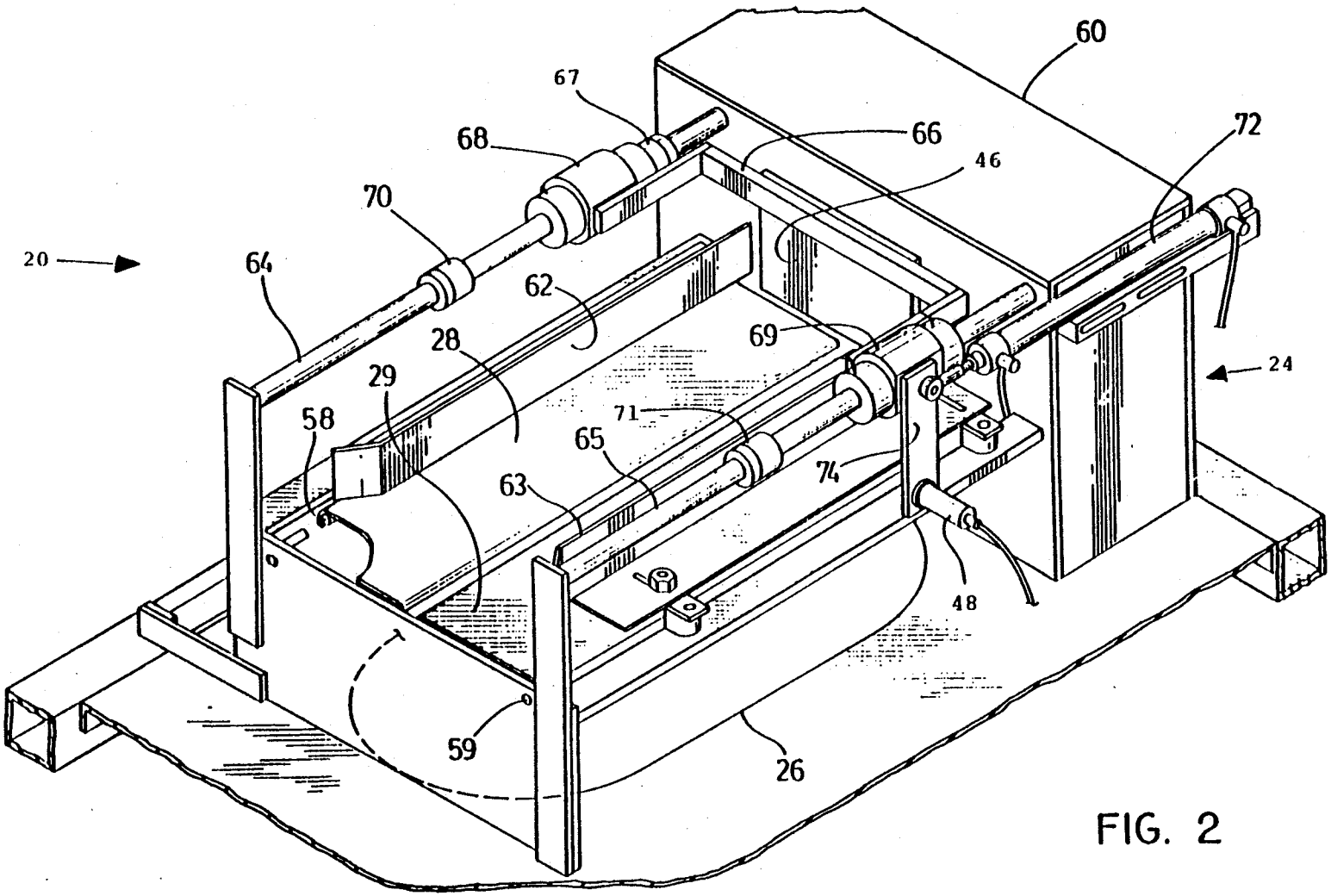
FIG. 2 is an enlarged perspective view of a stop plate and upper trap doors used in the machine.

In the preferred embodiment as shown in FIG. 1, packages 21 of potatoes enter a baling machine indicated generally by the numeral 20 on an elevating conveyor 22. The packages run onto an intermediate conveyor 23 which accelerates the packages to space them as they enter a loading station 24 from which the packages are dropped into a chute 26 by cyclicly releasing a pair of upper trap doors 28 and 29 (FIG. 2). When a selected number of packages to fill a bale bag have accumulated in the chute 26, a pair of lower trap doors 30 and 31 (shown in FIG. 4) are opened and the group of packages is allowed to fall into a receiving station below the chute and having an open bale bag 33 held as will be explained. There is a platform 32 located beneath the bale bag which is driven vertically from an upper position to a lower position at a rate to catch the group of packages as they fall into the bale bag to thereby cushion the fall of the packages. Next a pusher plate 34 moves from the retracted to an extended position to push the loaded bale bag 33 horizontally onto an exit conveyor 36. As the bag moves, the top of the bag is driven upwards by a bag conditioner 38 and secured closed by a conventional bag tying machine indicated generally by numeral 39.

Figure 5:
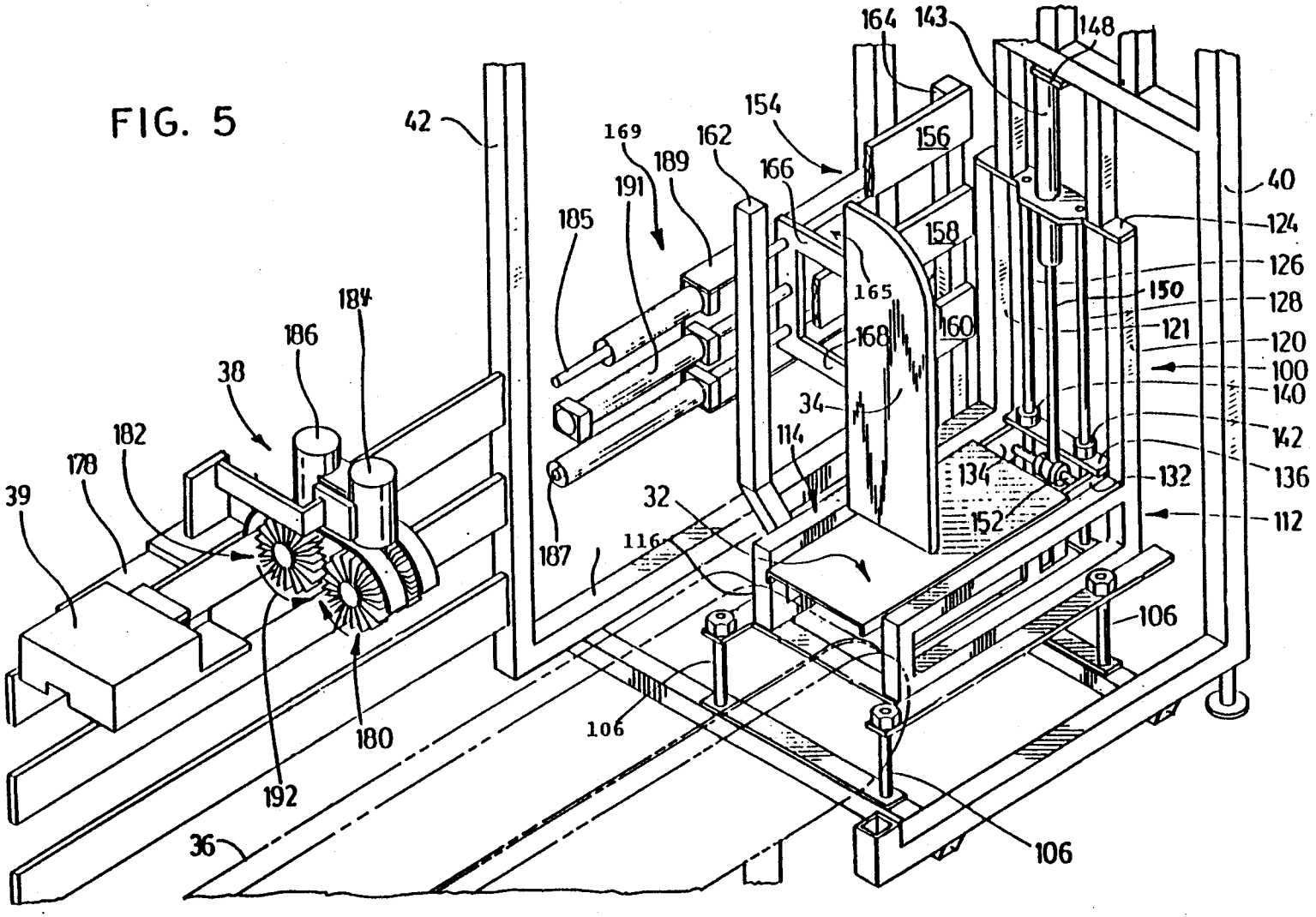
FIG. 5 is an enlarged isometric view of a lower portion of the machine viewed from the rear and showing details of a moving platform, pusher plate, exit conveyor and bag conditioner.

A more detailed description follows. As seen in FIGS. 1 and 5, support for the elements of the baling machine is provided by a frame 40 made up of vertical uprights connected by a number of horizontal cross members positioned to support the various parts of the baler.

Reference is now made to FIGS. 1 and 2. As the packages 21 reach the end of the elevating conveyor 22, the packages are received one at a time on the conveyor 23 which moves faster than the conveyor 22 to create a greater physical separation between successive packages and to project the packages over a connecting plate 44 onto the upper trap doors 28, 29, and into contact with a stop plate 46 which positions the packages on the trap doors. A sensor 48 (visible in FIG. 2) is located to one side of the stop plate 46 to detect the presence of a package and enables the control system (to be described with reference to FIG. 9) to open upper trap doors 28, 29 to allow the package to drop into the chute 26 located below these doors.

The loading station 24 is best illustrated in FIG. 2 where it can be seen that the doors 28, 29 rotate on pivots 58, 59 which run in a fore and aft direction parallel to the path of a package entering the loading station. The doors are moved by an actuator consisting of an electric motor and gear combination located inside a housing 60 positioned behind the stop plate 46. Respective guide fences 62, 63 are located on the trap doors 28 and 29 to assist in positioning packages on the doors.

As shown in FIG. 2, the stop plate 46 is located across the rear end of the upper trap doors. However the stop plate is mounted for travel on a pair of stop plate guide rods 64 and 65 which run above and to either side of the loading station. The plate is attached to a support 66 extending across the top of the stop plate 46 and fixed at its ends to bearing assemblies 68, 69 which run on the respective guide rods 64, 65. It is to be noted that the package sensor 48 is secured to the bearing assembly 69 by a bracket 74 so the sensor moves with the stop plate.

The assembly consisting of the stop plate 46, stop plate support 66, bearing assemblies 68, 69, and package sensor 48 can move along the stop plate guide rods 64 and 65 in a range defined by two stops 70, 71 located in front of the assembly on the respective stop plate guide rods and a further stop 67 located behind the assembly on the guide rod 64. Movement of the assembly is between a first position as drawn in FIGS. 1 and 2, and a second position indicated diagrammatically in FIG. 1 in ghost outline. The assembly is moved by pneumatic actuator 72 which is anchored to the housing 60 and has an actuator rod attached to the bearing assembly 69. More detailed operation of the loading station 24 will be given later in this description.

As mentioned previously, packages are dropped through the trap doors 28, 29 into the chute 26 which is visible from the side in FIG. 1 and in cross section from the top in FIG. 3. The chute consists of a tapered upper portion 73 which converges downwardly into a tubular lower portion 75. The upper portion funnels falling packages into the lower portion which is constructed in a modular fashion from sheet metal to include two similar curved end portions 76 and two flat side portions 77.

At the bottom of the chute 26 there are the pair of lower trap doors 30 and 31 which hold a group of packages accumulated in the chute, and a bag supplying apparatus. Details of this apparatus are visible in FIGS. 1 and 4.

As the baling machine is operated to fill the chute, the bag supply apparatus beneath the lower trap doors 30, 31 operates to pull a bag across the chute opening in preparation for receiving a stack of product bags. The doors 30, 31 are hinged horizontally on pivots 78, 79 which run fore and aft in parallel with the pivots 58, 59, (FIG. 2) of the upper trap doors. The pivots 78, 79 are fastened to vertical members of the frame 40 (FIG. 1) several inches above the lower edge of the chute on bearing blocks 80, 81 and the sides of the chute are cut out to receive the doors 30, 31.

Figure 4:
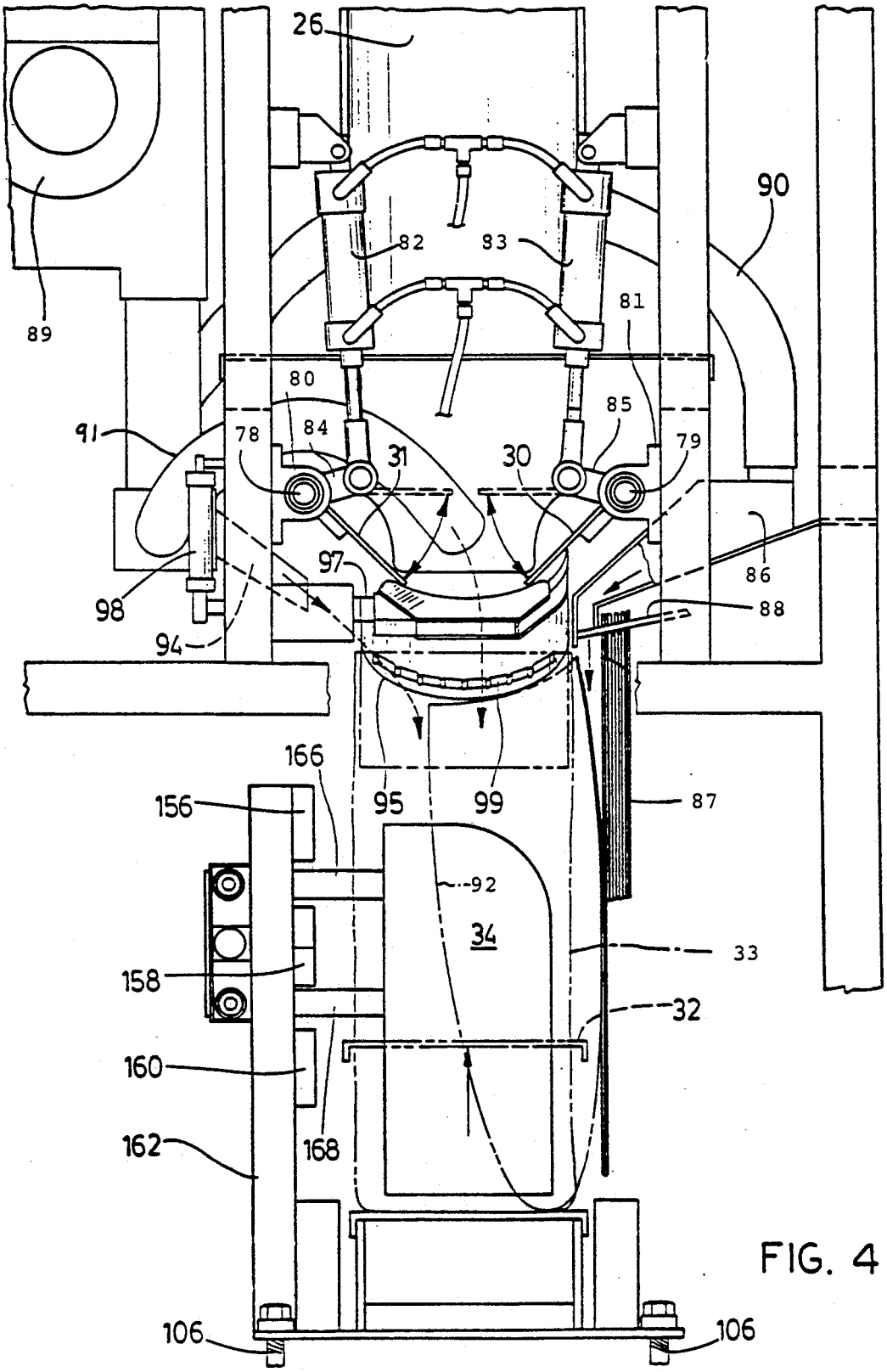
FIG. 4 is an enlarged rear view of the machine shown in FIG. 1 and showing lower trap doors and bag supply apparatus.

The lower trap doors are moved between an open position shown in full outline and a closed position shown in ghost outline in FIG. 4 by a pair of double acting pneumatic actuators 82, 83 anchored to adjacent vertical members of the frame while their rods are connected to short cranks 84, 85 which project inwardly from the lower trap door pivots 78, 79 respectively.

The bag supplying apparatus consists of two parts. Firstly, a bag blower is provided to blow into bale bags one at a time to open the bale bag into position across the bottom of the chute, and secondly a bag holder grips an open bale bag from the inside to hold it in place as packages are dropped into the bale bag.

The bag blower will be discussed with reference to FIG. 4. To the right of the lower end of the chute 26 (as drawn) there is provided a bag blowing manifold 86 beneath which a supply of bale bags 87 is suspended from a pair of inclined support pins 88 so that the bags tend to slide off the pins and towards the outlet end of manifold 86. Bale bags come folded flat with the upper edge of one side cut below the other and crimped so that the bag is easily opened by an air jet, and the uncut side is provided with two holes which fit over the support pins 88. The bags are of course placed on the support pins with the cutaway upper edge facing into the machine.

Air from a fan 89 (shown at the top left of FIG. 4) is supplied to manifold 86 via a hose 90 and air exits from an opening in the underside of the manifold. This air flow catches the cutaway edge of the bale bag hanging closest to the manifold because the bags tend to slide down the pins 88 and into contact with the manifold. The first bag is opened to some extent as indicated in ghost outline at 92 and then blown fully open by a combination of air from manifold 86 and from front and rear air hoses 91 (one of which is seen) and a second manifold 94. The front and rear air hoses direct air from fan 89 down through the chute 26 and into the partially open bale bag 92 with the bag open as indicated at 33.

Once the bale bag is opened and in position 33 beneath the chute, the bag holding system is actuated to grip the bag internally and hold the bag.

As also seen in FIGS. 1 and 4, the bag holder which forms the second part of the bag supplying apparatus includes two bag openers 93 and 95 which are located beneath the end of the chute 26, to hold bale bags open and to funnel falling product bags into them. The opener 93 is located at the front of the chute with its upper end below the lower edge of the chute and the opener 95 is located at the rear of the chute in a similar fashion. The rear opener 95 is shown in FIG. 4 pivoted part way up in an inactive position in solid outline and all of the way down in an active position in chain dotted outline. These openers are curved to hold the mouth of a bale bag open in a shape which conforms to the shape of the chute and to do this the openers pivot horizontally near their upper edges on respective cantilever pivots 97 which extend from adjacent vertical members of the frame 40. The openers are operated by pneumatic actuators 98 (one of which is seen in FIG. 4) in a manner similar to that described with reference to the lower trap doors 30 and 31.

In use the bag openers 93, 95 are pivoted up in the active position while a bale bag is being blown across beneath the chute opening. Once a bag is in place the bag openers are pivoted downwardly to stretch the mouth of the bag and to thereby grip the inside of the front and rear sides of the bag to hold the bag in place (as can be see in FIG. 1) and to strip this bag off the support pins 88. A piece of corrugated sheet metal 99 (FIG. 4) is fastened to the outside of each opener to facilitate gripping the bale bags.

Located beneath the chute and the bag holder are the moving platform 32 and pusher plate 34 which can be seen from the side in FIG. 1, the rear in FIG. 4 and in isometric projection in FIG. 5. The moving platform, pusher plate and their operating mechanisms are mounted on a sub-frame 100 which is supported on lower support frame cross members by bolts 106. The sub-frame 100, pusher plate 34 and moving platform 32 can be removed from the baling machine as a unit for replacement with other types of bag off-loading equipment or possibly for use on another type of baling machine.

As mentioned previously the moving platform 32 moves in a vertical direction and is designed to engage with falling product bags as they drop from the chute, and to gradually bring them to a halt to minimize impacts and thereby limit bruising. The moving platform is supported on the sub-frame 100 between two side frames 112 and 114 and respective vertical members 120, 121 rise from the side frames and are joined by a cross member 124. Platform guide rods 126, 128 are mounted in parallel below cross member 124.

In its lower position the moving platform 32 fits between the side frames 112, 114 and is supported by platform supports 132 and 134 which run along the underside of the platform on the right and left sides respectively. The platform supports 132 and 134 extend under the platform and overlap to the outsides of the platform guide rods 126 and 128. A platform bearing support 136 (which is visible in FIG. 5) runs between the upper edges of the platform supports 132 and 134 and is provided with holes for platform guide rods 126, 128, and bearings 140, 142 on the support 136 ride on the respective platform guide rods 126 and 128. Although not visible in FIG. 5 there is also a lower platform bearing support with two platform guide bearings, which is secured to the underside of the platform supports 132 and 134. The moving platform 32 can be moved vertically up and down the platform guide rods 126 and 128 on the platform guide bearings by a double acting pneumatic actuator 143. This actuator is anchored at 148 above the cross member 124.

An actuator rod 150 of the actuator 143 projects downwardly and is attached to a rod 152 which extends between platform supports 132 and 134 adjacent the bearing support 136. As a result energizing the actuator 143 will cause the platform to move between upper and lower positions as mentioned previously.

A bag support fence 154 is provided to prevent filled bale bags from falling off that side of the platform 32. A fence is not provided on the other side of the platform because there must be clear access for bag blowing. The entire sub-frame 100 can be tilted towards the fence 154 by adjusting the bolts 106 so that filled bale bags tend to lean against the fence rather than fall off the open side of the platform.

The fence 154 comprises three horizontal rails labelled from top to bottom 156, 158 and 160 which are supported on two vertical posts 162 and 164 rising from the sub-frame 100. The fence rails extend to the rear of the sub-frame 100 and are supported by an additional vertical post 176 attached to the exit conveyor 36 as shown in FIG. 1.

The pusher plate 34 is shown in FIG. 5 half way through its stroke from the retracted to the extended position. As mentioned previously, it is used to push loaded bale bags from the moving platform 32 onto the exit conveyor 36 and is operated only when the moving platform is in the lowered position. In its retracted position the pusher plate 34 sits adjacent the front vertical members 120 and 121 as can be seen from the side in FIG. 1. In this position the bottom of the pusher plate is aligned with an aperture defined by an end of the moving platform 32, the platform support rod 152, and the platform supports 132 and 134. As a result the moving platform can move vertically without interfering with the pusher plate 34. Support for the pusher plate 34 is provided by a U-shaped element having two horizontal arms 166, 168 projecting from a pusher plate support apparatus 169 located behind the bag support fence 154.

The support apparatus 169 consists essentially of two horizontal guide rods 185, 187 which slide in bearings provided in a guard plate 189 and in similar structure (not shown) at their other ends. The plate 189 is secured to vertical posts 162 and 164 and they extend between frame rails 156, 158, 160.

A double acting pneumatic actuator 191 is secured to the guard plate 189 and the element 165 between horizontal guide rods 185, 187 for activating the pusher plate 34.

Once filled, bale bags are pushed by plate 34 driven by actuator 191 onto the exit conveyor 36 which sits at the rear of the machine on legs 172, 174 (FIG. 1) with its conveying surface level with the moving platform 32 when the platform is in the lowered position. As noted previously, a vertical post 176 (FIG. 1) projects upwards from the left side of the conveyor to support the rear ends of fence rails 156, 158, 160. At the top of post 176 there is a support bar 178 running fore and aft which supports the bag conditioner 38 at its forward end and the bag tying machine 39.

The bag conditioner 38 which is visible in FIGS. 1 and 5 comprises two pairs of vaned wheels 180, 182 each pair of wheels being driven by one of a pair of electric motors, 184, 186. The wheels 180, 182 are arranged with their axes of rotation in a fore and aft direction and with their forward ends angled up approximately 5 degrees from the horizontal. In use the vaned wheels rotate in the direction of arrows 192 to drive the top of a passing bale bag upwards ready to be closed by the tying machine 39.

The baler can be controlled by any conventionally designed control system. For the purposes of completeness a suitable system will be described, and is indicated at 200 in FIG. 1. The system operates the baler in accordance with the flow chart shown in FIG. 9.

As stated previously the preferred embodiment is designed to bale 5 ten pound or 10 five pound product bags into a standard bale bag and so the baler must operate in two modes.

In a first mode the baler bales five 10 pound product bags into each bale bag. The process for baling 10 pound bags begins at box 202 in FIG. 9. At box 204 the fan 89 (FIG. 4) is turned on to blow a bale bag in position 93 beneath the chute 26. Next conveyor belts 22, 23 and 36 (FIG. 1) are turned on at box 206 in preparation for receiving packages. Once the actions in the box have been executed the baler loops continuously through the flow chart performing the functions in boxes 208 to 246 except for box 224 which is not executed when the baler is baling ten pound bags.

Figure 6:
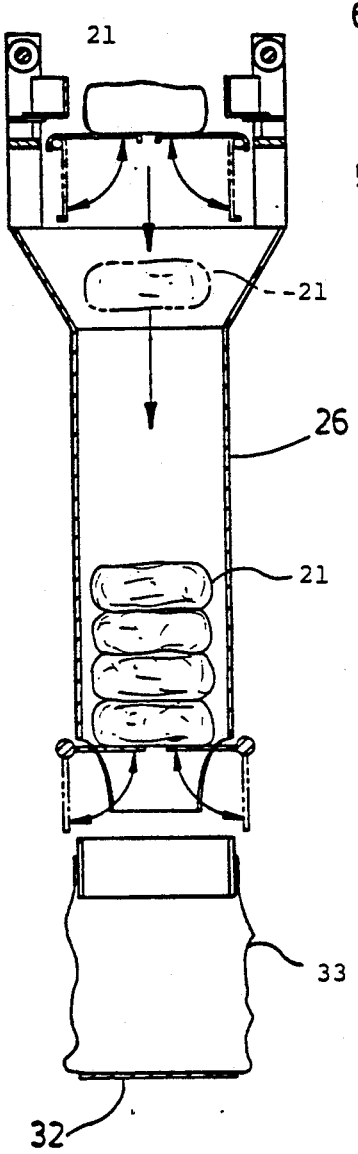
FIGS. 6, 7 and 8 are diagrammatic cross-sectional views from the rear and showing in sequence packages being stacked in the chute, falling, and landing on the moving platform.

Proceeding to box 208, the baler lowers bag openers 93, 95, to grip the bale bag and move it into position 33 (FIG. 4). Next at box 210 the moving platform 32 is raised to the upper position shown in FIG. 6. A decision is then made at box 212 as to whether a package is in place on the upper trap doors 28 and 29, the answer being provided by sensor 48, (FIG. 2). When there is no product bag present at the upper trap doors, the control system will cycle repetitively through box 212 until a package is sensed. Once a package, has been sensed, the count of packages in the chute 26 will be incremented at box 214. Next there will be a time delay as shown in box 216 to allow the sensed bag to hit the stop plate 46 and come to rest before the upper trap doors 28 and 29 are opened at box 218. There is a short time delay at box 220 to allow the package which has been dropped into the chute 26 to clear the upper trap doors before they are closed at box 222.

Box 224 is shown in ghost outline to indicate that the actions in this box are not executed when bailing ten pound product bags. When bailing 10 pound bags the stop plate must be in its rearmost position as shown in FIG. 2 to leave enough room on the upper trap doors 28 and 29 for a bag. At box 226 the package count is checked to determine if the chute contains enough packages to fill a bale bag. If not, the system will loop back to the box 212 to accumulate an additional package otherwise it will proceed to box 228.

Figure 7:
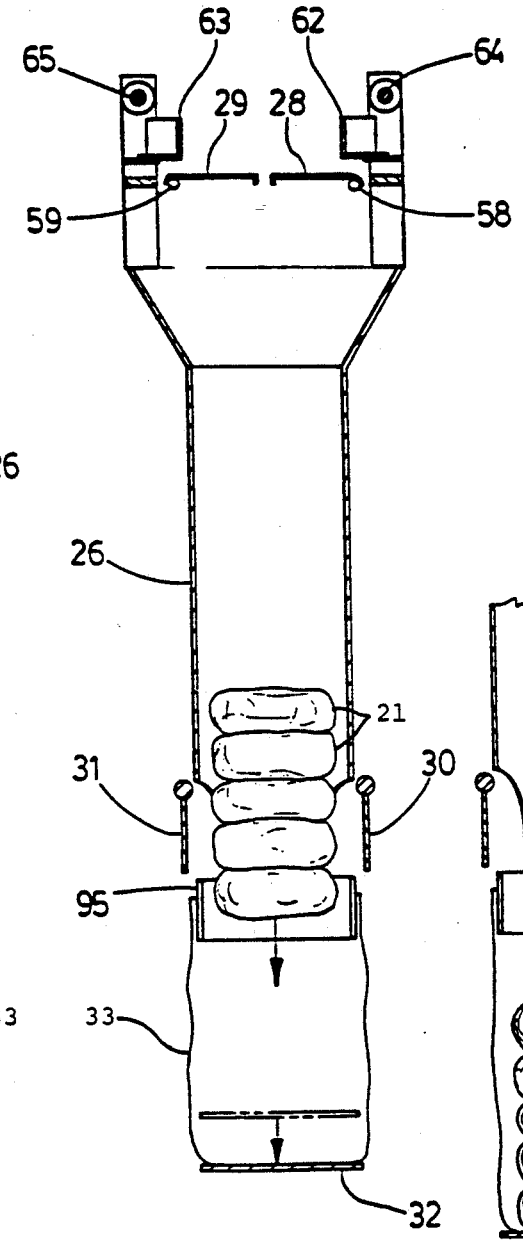
Figure 8:
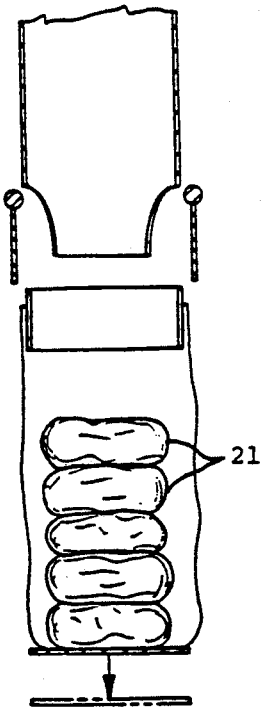

There is a time delay at box 228 to allow the last package dropped by the upper trap doors 28 and 29 to come to rest before the lower trap doors 30 and 31 are opened at box 230 and the stack of accumulated packages allowed to drop into the open bale bag 33 as shown in FIGS. 7 and 8.

After a short time delay the moving platform 32 is driven downwardly as indicated in box 234. Timing of the platform drop is important because it must be moving downwards as the stack of product bags meets it to minimize product damage.

There is another short time delay at box 236 to allow the stack of packages to clear the chute 26 before the lower trap doors 30 and 31 are closed at box 238. At box 240 the bag openers 93, 95 are pivoted up to clear the now full bale bag. At box 242 the pusher plate 34 is moved to slide the full bale bag onto the exit conveyor 36 and at box 244 the pusher plate is retracted. Finally, the package counter is reset at box 246 because the chute 26 is now empty. After box 246 the control system loops back the box 208 to begin accumulating packages in the chute once again.

Figure 9:
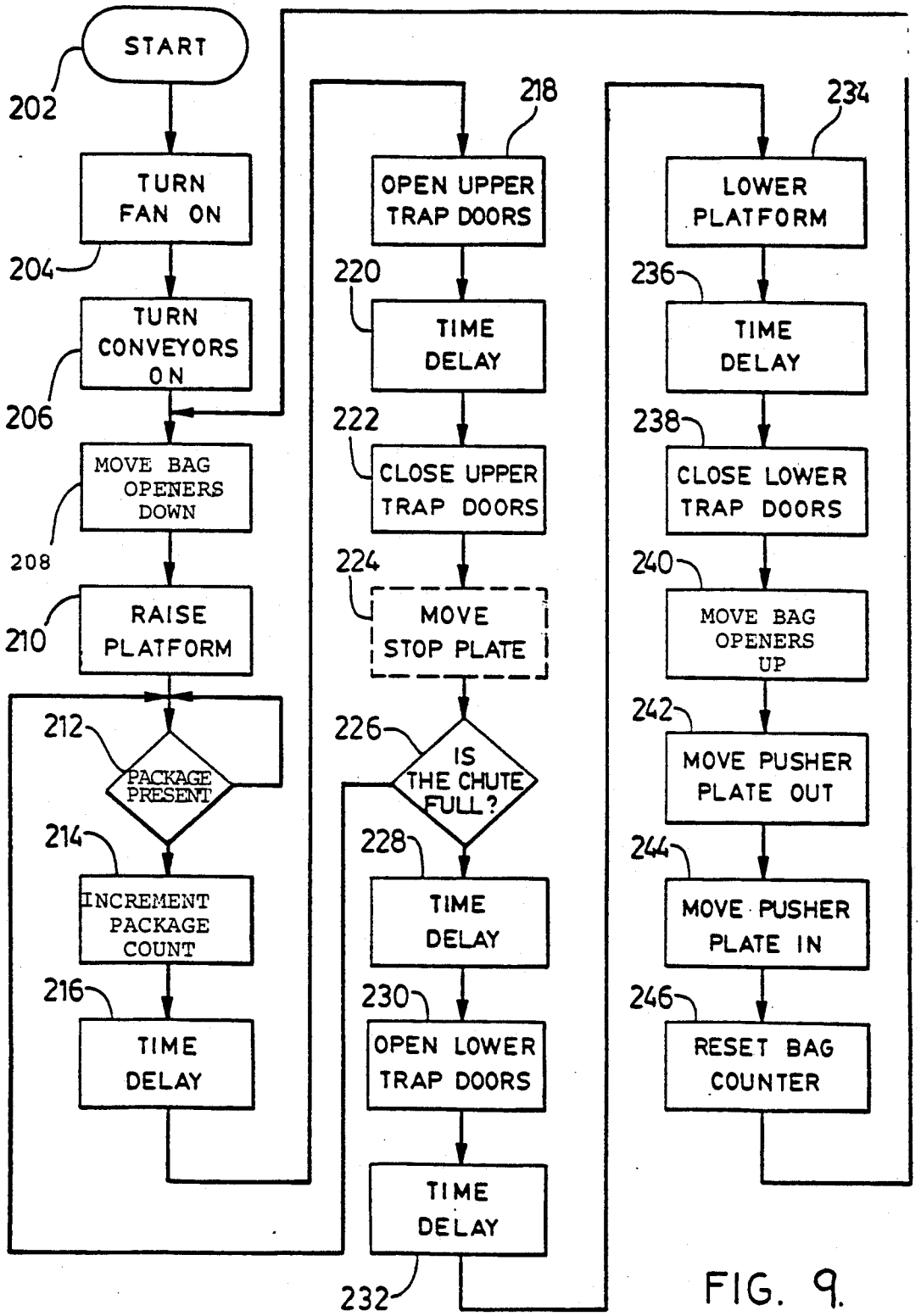
FIG. 9 is a flow chart included for completeness and describing the operation of the baling machine.

When five pound packages are being baled the baler also operates in accordance with the flowchart shown in FIG. 9 except that at box 224 the stop plate is moved cyclically so that the smaller five pound packages end up stacked in the bale bag in a staggered pile with a partial overlap between adjacent packages as shown in FIG. 1. More packages of five pound potatoes may be stacked into each bale bag in this manner and a single size of bale bag may be used for both five and ten pound product bags.

The bag conditioner 38 operates continuously when the baler is running.

Although particular processes and apparatus have been described herein, it will be apparent to those skilled in the art that various changes and modifications can be made in specific details thereof, within the scope of the appended claims.

I claim:

1. In a baling machine having an elevating conveyor, a loading station receiving individual packages from the elevating conveyor, a chute below the loading station, upper trap doors at the loading station for dropping individual packages into the chute, lower trap doors at the bottom of the chute for receiving and accumulating the packages into groups of packages, and a receiving station for placing individual groups of packages into bale bags, said lower trap doors being operable to release a group of packages for travel to the receiving station, the improvement comprising:

a platform located beneath the chute at the receiving station and moveable between a lower position for supporting a full bale bag and an upper position closer to the chute; an actuator coupled to the platform, and means responsive to the operation of the lower trap doors to release a group of packages to operate said actuator after said operation of the lower trap doors at a rate to move the platform downwardly from the upper to the lower position to cause the group of packages, as the group of packages falls into a bale bag being supported by the platform, to engage the downwardly moving platform and then travel with the platform to minimize impact between the group of packages and the platform.

2. Structure as claimed in claim 1 and further comprising a pusher plate operable to move the full bale bags horizontally off the platform in the lower position.

3. In a bailing machine having an elevating conveyor, a loading station receiving individual packages from the elevating conveyor, a chute below the loading station, upper trap doors at the loading station for dropping individual packages into the chute, each individual package having a path of travel from the elevating conveyor to the upper trap doors, lower trap doors at the bottom of the chute for receiving and accumulating the packages into groups of packages, and a receiving station for placing individual groups of packages into bale bags, said lower trap doors being operable to release a group of packages for travel to the receiving station, the improvement comprising:

a stop plate and means for mounting said stop plate above the upper trap doors in the path of travel of the individual packages from the elevating conveyor to the upper traps doors, the stop plate being moveable longitudinally in said path of travel; and stops mounted on the loading station to locate the stop plate in one of two predetermined positions to stop alternate packages in the two positions so that on dropping the packages onto the lower trap doors the resulting group of packages is made up of packages staggered one above the other to maximize the use of space in the bale bag.

4. In a bailing machine having an elevating conveyor, a loading station receiving individual packages from the elevating conveyor, a chute below the loading station, upper trap doors at the loading station for dropping individual packages into the chute, each individual package having a path of travel from the elevating conveyor to the upper trap doors, lower trap doors at the bottom of the chute for receiving and accumulating the packages into groups of packages, and a receiving station for placing individual groups of packages into bale bags, said lower trap doors being operable to release a group of packages for travel to the receiving station, the improvement comprising:

a stop plate and means for mounting said stop plate above the upper trap doors in the path of travel of the individual packages from the elevating conveyor to the upper traps doors, the stop plate being moveable longitudinally in said path of travel; and stops mounted on the loading station to locate the stop plate in one of two predetermined positions to stop alternate packages in the two positions so that on dropping the packages onto the lower trap doors the resulting group of packages is made up of packages staggered one above the other to maximize the use of space in the bale bag; and a platform located beneath the chute at the receiving station and moveable between a lower position for supporting a full bale bag and an upper position closer to the chute; an actuator coupled to the platform, and means responsive to the operation of the lower trap doors to release a group of packages to operate said actuator after said operation of the lower trap doors at a rate to move the platform downwardly from the upper to the lower position to cause the group of packages, as the group of packages falls into a bale bag being supported by the platform, to engage the downwardly moving platform and then travel with the platform to minimize impact between the group of packages and the platform.

5. Structure as claimed in claim 4 and further comprising a pusher plate operable to move the full bale bags horizontally off the platform in the lower position.

* * * * *